US006456182B1

(12) United States Patent
Katayama et al.

(10) Patent No.: US 6,456,182 B1
(45) **Date of Patent: *Sep. 24, 2002**

(54) COMMON MODE CHOKE COIL

(75) Inventors: Norio Katayama, Shizuoka-ken (JP); Toshinori Okamoto, Shizuoka-ken (JP)

(73) Assignee: Minebea Co., Ltd., Miyota (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/518,273

(22) Filed: Mar. 3, 2000

(30) Foreign Application Priority Data

May 20, 1999 (JP) ..... 11-139962

(51) Int. Cl.[7] ..... H01F 27/34
(52) U.S. Cl. ..... 336/181; 336/170; 336/83
(58) Field of Search ..... 336/83, 170, 200, 336/212, 181, 215, 221, 214

(56) References Cited

U.S. PATENT DOCUMENTS 3,315,087 A * 4/1967 Ingenito ..... 307/88
4,160,966 A * 7/1979 Kennedy ..... 336/155
4,914,381 A * 4/1990 Narod ..... 324/117 R
5,430,613 A * 7/1995 Hastings et al. ..... 361/760
5,581,224 A * 12/1996 Yamaguchi ..... 356/212
5,719,546 A * 2/1998 Ito et al. ..... 336/180
5,895,544 A * 4/1999 Finn et al. ..... 156/276

FOREIGN PATENT DOCUMENTS

JP U-62-197823 12/1987
JP U-4-32513 3/1992

* cited by examiner

*Primary Examiner*—Lincoln Donovan
*Assistant Examiner*—Kyung S. Lee
(74) *Attorney, Agent, or Firm*—Oliff & Berridge, PLC

(57) ABSTRACT

In a common mode choke coil, a closed magnetic circuit core (2) is divided in parallel with its magnetic circuit, and formed by superimposing together for integration a first divided magnetic core (2*a*), a second divided magnetic core (2*b*) and a third divided magnetic core (2*c*) which are made of an oxide magnetic substance having the high permeability. Since the closed magnetic circuit core (2) is made of the oxide magnetic substance having the high permeability, the impedance in the low frequency band (10 kHz side) is large. Also, since the sectional area of the closed magnetic circuit core (2) (divided magnetic core) is set to be small, the permeability in the high frequency band (10 MHz side) becomes high due to the dimensional resonance phenomenon, and then the impedance also becomes large. For that reason, the noise in the wide frequency band of 10 kHz to 10 MHz can sufficiently be attenuated.

3 Claims, 5 Drawing Sheets

COMMON MODE CHOKE COIL

BACKGROUND OF THE INVENTION

1. Field of the Invention

The present invention relates to a common mode choke coil for blocking a common mode noise current that flows in one of an input terminal and an output terminal and passes through the other terminal over a wide frequency band.

2. Description of the Related Art

The basic circuit structure of a general noise filter for attenuating a common mode noise (common mode noise current) is made up of a common mode choke coil in which an insulated copper wire is wound in same phase on a closed magnetic circuit core (a ferrite core is frequently used), an inter-line capacitor (called also "X-capacitor") for removing a differential mode noise, and a line bypass capacitor (called also "Y-capacitor") for attenuating a common mode noise over a wide band.

The frequency band whose terminal noise to be regulated widely ranges from 10 kHz to 30 MHz, and its attenuating method is that the high frequency band components of the common mode noise are attenuated by a filter circuit essentially consisting of a common mode choke coil and a bypass capacitor, and the low frequency band components of the common mode noise are attenuated by making the impedance of the common mode choke coil high.

As a performance required for the common mode choke coil, it is desirable that the impedance is as large as possible to at least the frequency components of 10 kHz to 10 MHz (10,000 kHz) of the common mode noise. That is, there is required that the inductance is as large as possible in such a wide frequency range.

Up to now, as the closed magnetic circuit core, there are many cases in which the ferrite core is employed from the viewpoints of the costs and mass-production. Also, as the configuration of the magnetic core, the toroidal magnetic core is frequently employed. As other configurations, EE type, EI type, UU type, two-square-combined type or square-type magnetic core may be also used.

The common mode choke coil may be connected directly to the commercial AC line for use. In this event, consideration must be made on the safety from the viewpoint of withstanding voltage. Also, the common mode choke coil is used in the case where the common mode choke coil is inserted into a large-current circuit, since a bold wire must be wound on the magnetic core taking an obstacle caused by a rise in the temperature of the winding into account, the configuration is restricted by itself.

As a conventional example of the above-described common mode choke coil, a common mode choke coil 1 is shown in FIGS. 5 and 6.

Referring to FIG. 5, reference numeral 2 denotes a ring-shaped closed magnetic circuit core, and the closed magnetic circuit core 2 is inserted into an insulating case 3 made of plastics. The insulating case 3 is made up of a first case 4 and a second case 5 which are superimposed together. As shown in FIG. 6, two coils 6 and 7 are wound on the insulating case 3 into which the closed magnetic circuit core 2 is inserted (and then the closed magnetic circuit core 2 through the insulating case 3) in such a manner that magnetic fluxes developed by those two coils 6 and 7 cancel each other. In the present specification, those two coils 6 and 7 are called "first coil 6" and "second coil 7", respectively, for convenience.

Incidentally, in order to increase the attenuation amount of the common mode noise at the frequency band from 10 kHz to 10 MHz, the common mode choke coil has been required to increase the impedance of the common mode choke coil with respect to the common mode noise. That is, there has been required that the impedance of the winding increases at the frequency band from 10 kHz to 10 MHz.

To satisfy the above requirement, there have been countermeasures in which the coils usually employed are increased in size, two coils are connected in series, and so on. However, those countermeasures have not always been excellent because those may accompany an increase in costs, an increase in the number of parts to be used, an increase in the mounted space, etc.

Also, in order to increase the impedance particularly at a low frequency band, the number of turns of the coil is increased as large as possible, or a high permeability material is used as the magnetic core. However, in this case, the common mode choke coil has the characteristic that the increased number of turns leads to an increase in-line distributed capacity and the characteristic that the deterioration of the permeability is larger in the high frequency as the magnetic material is higher in permeability, as a result of which the deterioration of the impedance in the high frequency band becomes remarkable.

Also, in order to improve the frequency characteristic of the impedance in a wide band, there has been proposed a structure in which two kinds of magnetic cores different in frequency characteristic are disposed in parallel and then a coil is wound on those magnetic cores, such that a carbonyl iron dust core and a ferrite core are together as disclosed in, for example, Japanese Utility Model Laid-Open Publication No. Hei 4-32513, and that a magnetic core on which an amorphous magnetic material is wound and a dust core are combined together as disclosed in Japanese Utility Model Laid-Open Publication No. Sho 62-197823.

However, the structures disclosed in the above publications cannot sufficiently cover a wide frequency band of from 10 kHz to 10 MHz (that is, they cannot sufficiently increase the impedance so that the noise can be sufficiently attenuated in a wide frequency band from 10 kHz to 10 MHz).

On the other hand, in recent years, various electronic devices have progressively been downsized, reduced in the number of parts, saved in resource, saved in power and reduced in costs, and a common mode choke coil which is downsized and small in the number of turns as compared with the conventional one and can cover a wide frequency band by one choke coil has been demanded.

SUMMARY OF THE INVENTION

The present invention has been made in view of the above circumstances, and therefore an object of the present invention is to provide a common mode choke coil which is small in size and the number of turns and which can cover a wide frequency band by one choke coil.

In order to achieve the above object, according to a first aspect of the present invention, there is provided a common mode choke coil having two coils which are wound on a closed magnetic circuit core such that magnetic fluxes of the two coils cancel each other, characterized in that the closed magnetic circuit core is configured such that the closed magnetic circuit core is divided in parallel with the magnetic circuit thereof, and a plurality of divided magnetic cores which are formed of oxide magnetic substance made of the same material or the same kind of material are superimposed together for integration.

According to a second aspect of the invention, there is provided a common mode choke coil as defined in the first aspect, characterized in that the common mode choke coil comprises an insulating case into which the closed magnetic circuit core is inserted, and the coils are wound on the closed magnetic circuit core through the insulating case.

According to a third aspect of the invention, there is provided a common mode choke coil as defined in the first or second aspect, characterized in that the plurality of divided magnetic cores are identical in configuration with each other.

According to a fourth aspect of the invention, there is provided a common mode choke coil as defined in any one of the first to third aspects, characterized in that a shock absorber is interposed in at least one of a space between the insulating case and the closed magnetic circuit core and a space between the divided magnetic cores which are superimposed together.

According to a fifth aspect of the invention, there is provided a common mode choke coil as defined in any one of the first to third aspects, characterized in that adhesives are coated on at least one of a portion between the insulating case and the closed magnetic circuit core and a portion between the divided magnetic cores which are superimposed together.

According to a sixth aspect of the invention, there is provided a common mode choke coil as defined in the fourth or fifth aspect, characterized in that a gap is formed in at least one of a portion between the insulating case and the closed magnetic circuit core and a portion between the adjacent divided magnetic cores.

BRIEF DESCRIPTION OF THE DRAWINGS

The novel features believed characteristic of the itself, however, as well as other features and advantages thereof, will be best understood by reference to the detailed description which follows, read in conjunction with the accompanying drawings, in which.

DETAILED DESCRIPTION OF THE PREFERRED EMBODIMENTS

Now, a description will be given in more detail of preferred embodiments of the present invention with reference to the accompanying drawings.

First, a common mode choke coil 1 in accordance with a first embodiment of the present invention will be described with reference to FIGS. 1, 5 and 6.

Figure 1:
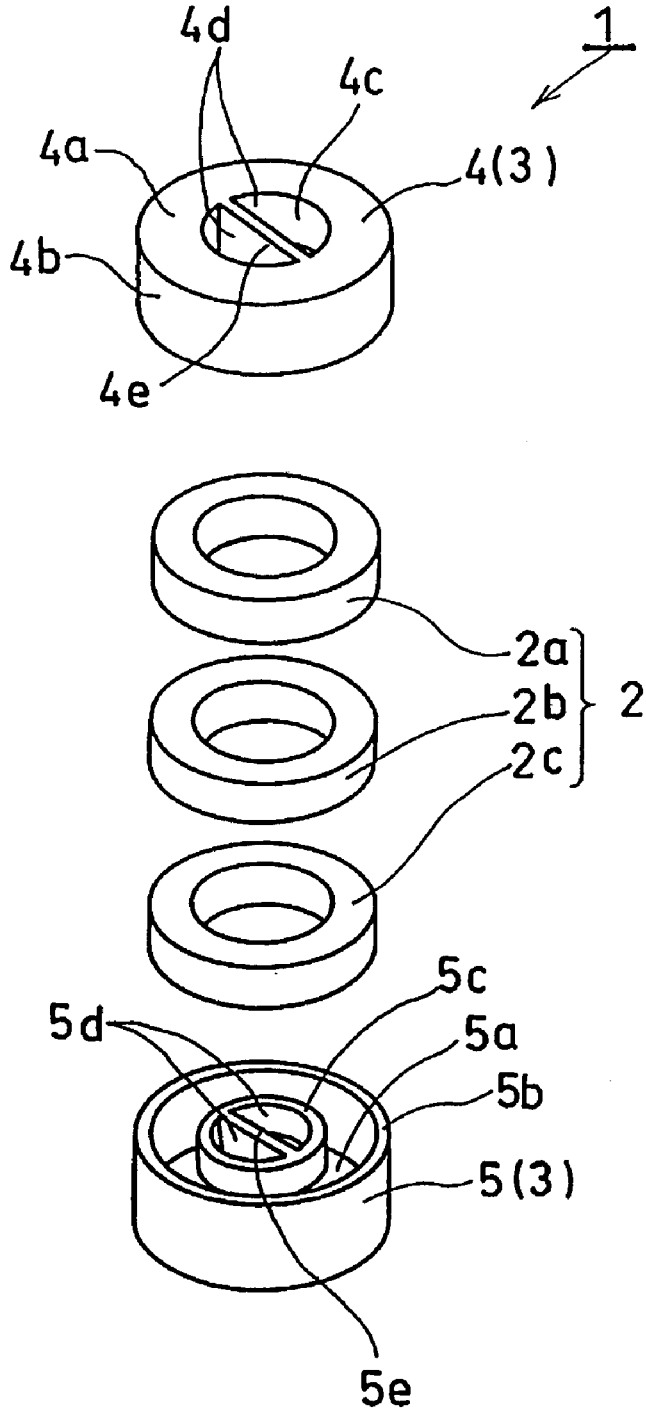
FIG. 1 is an exploded perspective view (assembly view) showing a common mode choke coil in accordance with a first embodiment of the present invention.

Referring to FIG. 1, the common mode choke coil 1 is essentially made up of a ring-shaped closed magnetic circuit core 2, an insulating case 3 made of plastics into which the closed magnetic circuit core 2 is inserted, and a first coil 6 and a second coil 7 (refer to FIG. 6) which are wound on the insulating case 3 (and then the closed magnetic circuit core 2) in such a manner that their magnetic fluxes cancel each other.

The insulating case 3 is made up of a first case 4 and a second case 5 which are thin and substantially double-cylindrical, and the first case 4 and the second case 5 have substantially the same configuration. The first case 4 is essentially made up of an outer cylinder (hereinafter referred to as "first outer cylinder") 4*b* having an annular bottom portion (hereinafter referred to as "first annular bottom portion") 4*a*, an inner cylinder ("magnetic core inserted portion") (hereinafter referred to as "first inner cylinder") 4*c* which is erected from the first annular bottom portion 4*a* and penetrates the closed magnetic circuit core 2, and a plate portion (hereinafter referred to as "first plate portion") 4*e* disposed so as to section the inner side of the first inner cylinder 4*c* into two space portions (first space portion 4*d*).

Similarly to the first case 4, the second case 5 is essentially made up of an outer cylinder (hereinafter referred to as "second outer cylinder") 5*b* having an annular bottom portion (hereinafter referred to as "second annular bottom portion") 5*a*, an inner cylinder (hereinafter referred to as "second inner cylinder") 5*c*, and a plate portion (hereinafter referred to as "second plate portion") 5*e* disposed so as to section the inner side of the second inner cylinder 5*c* into two space portions (second space portions) 5*d*. The first case 4 and the second case 5 are designed in such a manner that a top face portion of the first outer cylinder 4*b* and a top face portion of the second outer cylinder 5*b* are put one on the other, and a top face portion of the first inner cylinder 4*c* and a top face portion of the second inner cylinder 5*c* are put one on the other, to thereby constitute the insulating case 3. The closed magnetic circuit core 2 penetrates the first inner cylinder 4*c* and the second inner cylinder 5*c* (magnetic core inserted portion) and fitted into a gap (its reference numerals is not shown) between the first outer cylinder 4*b* and the first inner cylinder 4*c* and a gap (its reference numeral is not shown) between the second outer cylinder 5*b* and the second inner cylinder 5*c*, as described above.

The first coil 6 and the second coil 7 are wound on the insulating case 3 (and then the closed magnetic circuit core 2) in such a manner that the first coil 6 and the second coil 7 pass through the space portions (first space portions 4*d*) defined between the first inner cylinder 4*c* and the first plate portion 4*e* and the space portions (second space portions 5*d*) defined between the second inner cylinder 5*c* and the second plate portion 5*e*.

The closed magnetic circuit core 2 is configured such that the closed magnetic circuit core 2 is divided in parallel with its magnetic circuit, is formed by superimposed together for integration a plurality of divided magnetic cores (made up of three divided magnetic cores consisting of a first divided magnetic core 2*a*, a second divided magnetic core 2*b* and a three divided magnetic core 2*c* in this embodiment) which are formed of an oxide magnetic substance made of the same material or the same kind of material and have the same configuration.

In this example, the first divided magnetic core 2*a* and the second divided magnetic core 2*b*, and the second divided magnetic core 2*b* and the third divided magnetic core 2*c* are together without any electric insulator, respectively, interposed therebetween. Some of the conventional examples include any electric insulator between the divided magnetic cores in order to reduce an eddy current loss caused by a change in the magnetic flux of the magnetic cores. On the other hand, this embodiment has no electric insulator between the divided magnetic cores differently from the conventional example. The reason why no electric insulator is provided between the divided magnetic cores as described above is that the present embodiment aims to increase the resonant frequency of the dimensional resonance effect (the dimensional resonance phenomenon that influences the permeability in a high frequency band) as described later, which is different from the prior art which reduces the eddy current loss (as a result, the permeability and then impedance are increased).

Attention is paid to the dimensional resonance phenomenon which will be described later, and the sectional area of the closed magnetic circuit core 2 (divided magnetic core) is set to a smaller value. This is based on the following reason. That is, as the sectional area of the closed magnetic circuit core 2 (divided magnetic core) is larger, the resonant frequency becomes smaller, as a result of which the permeability (and then the impedance) in the high frequency band becomes smaller (in other words, as the sectional area of the closed magnetic circuit core 2 (divided magnetic cores) is smaller, the resonant frequency becomes higher with the result that the permeability (and then the impedance) in the high frequency band becomes larger).

Now, a description will be given of the dimensional resonance effect that influences the permeability in the high frequency band.

It is presumed that a rapid deterioration of the permeability $\mu$ in the vicinity of 1 MHz to 2 MHz is caused by the generation of the standing wave of an electromagnetic wave in the magnetic core.

If the relative permeability of a material is $\mu_r$ and the relative permeability of the material is $\epsilon_r$, the wavelength $\lambda$ of the electromagnetic wave that passes through the material is represented by the following equation (1):

$$\lambda=(c/f)\times\epsilon_r^{0.5}\times\mu_r^{0.5} \quad (1)$$

where c is the velocity of light and f is a frequency.

If the magnetic core has a thickness integer times or half integer times as large as the wavelength $\lambda$, the standing wave is generated in the interior of the magnetic core, and the resonance phenomenon occurs. This phenomenon is generally called "dimensional resonance phenomenon".

If the dimensional resonance phenomenon occurs in the magnetic core, the permeability of the magnetic core is rapidly changed.

The frequency that causes the resonance phenomenon is changed in accordance with the sectional area of the magnetic core. The resonant frequency becomes lower as the sectional area is larger, with the results that the permeability in the high frequency band becomes lower, and the impedance becomes smaller. In other words, the resonant frequency becomes higher as the sectional area of the magnetic core is smaller, with the results that the permeability in the higher frequency band becomes high, and the impedance becomes larger.

In common mode choke coil 1 structured above, the closed magnetic circuit core 2 is made of oxide magnetic substance having the high permeability, and the impedance in the low frequency band (that is, the frequency band close to 10 kHz out of the frequency band of 10 kHz to 10 MHz) becomes larger.

Also, the sectional area of the closed magnetic circuit core 2 (divided magnetic cores) is set to a small value, and the resonant frequency becomes high due to the dimensional resonance phenomenon, and the permeability in the high frequency band (that is, the frequency band close to 10 MHz out of the frequency band of 10 kHz to 10 MHz) becomes large, and the impedance becomes large.

For that reason, the impedance becomes larger over the wide frequency band of 10 kHz to 10 MHz, and the noise in the wide frequency band of 10 kHz to 10 MHz can sufficiently be attenuated. In this situation, since the noise in the wide frequency band is sufficiently attenuated without an increase in the number of turns of the coil or without the connection of two coils in series, the common mode choke coil can be downsized and the number of turns can be reduced as much.

Also, in this embodiment, the first divided magnetic core 2*a*, the second divided magnetic core 2*b* and the third divided magnetic core 2*c* have the same configuration, and the productivity can be improved as much.

Since the closed magnetic circuit core 2 is structured by superimposing together the first divided magnetic core 2*a*, the second divided magnetic core 2*b* and the third divided magnetic core 2*c*, the thickness of the first divided magnetic core 2*a*, the second divided magnetic core 2*b* and the third divided magnetic core 2*c* is thinned. As a result, when the first divided magnetic core 2*a*, the second divided magnetic core 2*b* and the third divided magnetic core 2*c* are sintered, rapid heating and rapid cooling can be conducted, to thereby reduce the consumption of energy and remarkably reduce the costs and reduce the environment load.

Figure 5:
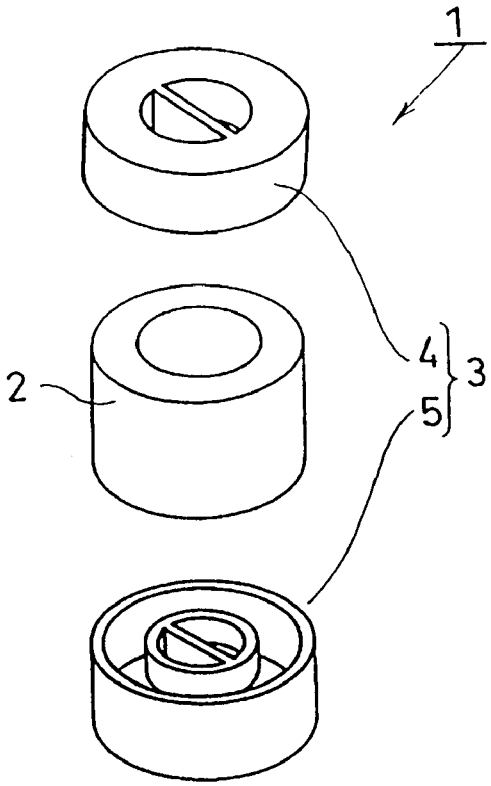
Fig.5 PRIOR ART
FIG. 5 is an exploded perspective view (assembly view) showing a common mode choke coil in one conventional example.
Figure 6:
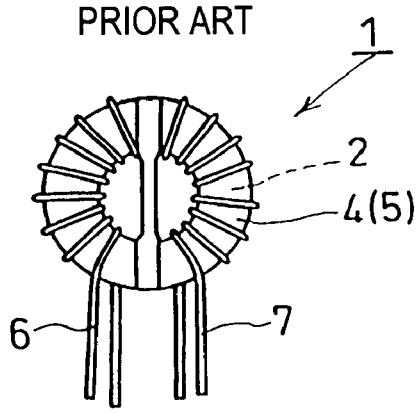
Fig.6 PRIOR ART
FIG. 6 is a plan view showing a closed magnetic circuit core shown in FIG. 5 and a coil wound on the closed magnetic circuit core.

In other words, the conventional example shown in FIGS. 5 and 6 suffers from the following problem. That is, since the thickness of the closed magnetic circuit core 2 (ferrite core) is thick, when the closed magnetic circuit core 2 is sintered, the rapid heating and the rapid cooling are not readily conducted because a breakage of magnetic core is caused, and the consumption of energy is increased as much. On the contrary, in this embodiment, such a problem can be eliminated as described above. In the case where the common mode choke coil 1 is employed in a device which is relatively large in power consumption, since the thick closed magnetic circuit core 2 is used, the present invention can reduce the energy consumption as compared with the conventional example.

Subsequently, a second embodiment of the present invention will be described with reference to FIG. 2.

Figure 2:
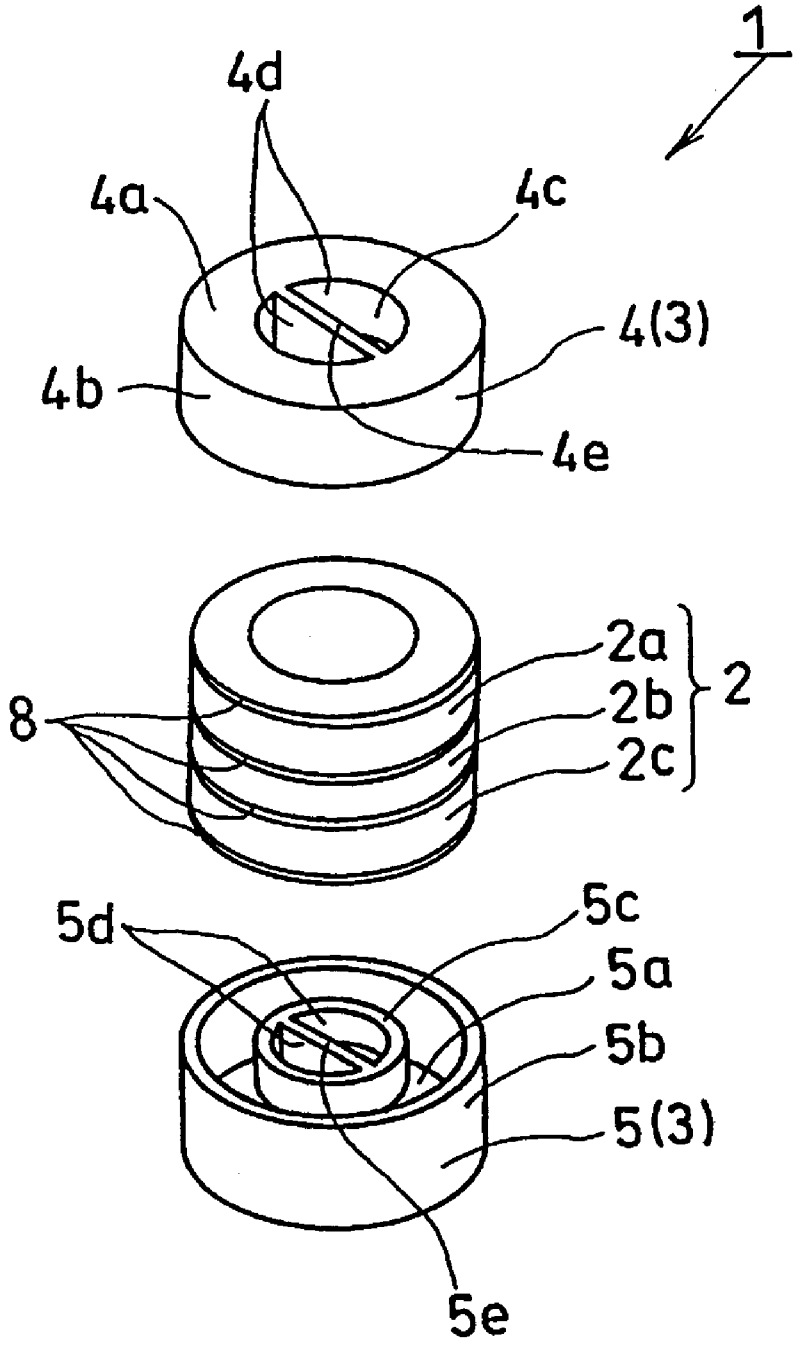
FIG. 2 is an exploded perspective view (assembly view) showing a common mode choke coil in accordance with a second embodiment of the present invention.

Referring to FIG. 2, a resin 8 that serves as a shock absorber is inserted between the first annular bottom portion 4*a* of the first case 4 and the closed magnetic circuit core 2, between the second annular bottom portion 5*a* of the second case 5 and the closed magnetic circuit core 2, between the first divided magnetic core 2*a* and the second divided magnetic core 2*b*, and between the second divided magnetic core 2*b* and the third divided magnetic core 2*c*. Also, the first coil 6 and the second coil 7 are wound on the insulating case 3 into which the closed magnetic circuit core 2 is inserted in such a manner that the first coil 6 and the second coil 7 pass through the space portions (first space portions 4*d*) defined between the first inner cylinder 4*c* and the first plate portion 4*e* and the space portions (second space portions 5*d*) defined between the second inner cylinder 5*c* and the second plate portion 5*e* as in the above first embodiment.

In this embodiment, the closed magnetic circuit core is inserted into the thin insulating case 3, and the first coil 6 (thick insulated wire) and the second coil 7 (thick insulated wire) are wound on the thin insulating case 3. As a result, even if a large force is exerted on the closed magnetic core 2 side, since the resin 8 that serves as a shock absorber is inserted between the first case 4 and the closed magnetic circuit core 2, between the second case 5 and the closed magnetic circuit core 2, between the first divided magnetic core 2*a* and the second divided magnetic core 2*b*, and between the second divided magnetic core 2*b* and the third divided magnetic core 2*c*, a large mechanical impact and stress are prevented from being applied to the closed magnetic circuit core 2 (the first divided magnetic core 2*a*, the second divided magnetic core 2*b*, and the third divided magnetic core 2*c*), to thereby make it possible to prevent the closed magnetic circuit core 2 from being broken and the permeability from being deteriorated.

In this embodiment, the resin 8 is inserted between the first annular bottom portion 4*a* of the first case 4 and the closed magnetic circuit core 2, between the second annular bottom portion 5*a* of the second case 5 and the closed magnetic circuit core 2, between the first divided magnetic core 2*a* and the second divided magnetic core 2*b*, and between the second divided magnetic core 2*b* and the third divided magnetic core 2*c*. Instead of this embodiment, the resin 8 may be inserted only between the first annular bottom portion 4*a* of the first case 4 and the closed magnetic circuit core 2 and between the second annular bottom portion 5*a* of the second case 5 and the closed magnetic circuit core 2.

Also, the resin 8 may be inserted only between the first divided magnetic core 2*a* and the second divided magnetic core 2*b*, and between the second divided magnetic core 2*b* and the third divided magnetic core 2*c*.

In the structure of FIG. 2, the resin 8 may be replaced by adhesives so that the respective parts adhere to each other, and the respective adhesive portions are fixedly integrated together (hereinafter referred to as "third embodiment"). According to the third embodiment, corresponding parts are firmly integrated together with adhesives, as a result of which a large mechanical impact and stress are prevented from being applied to the closed magnetic circuit core 2 (the first divided magnetic core 2*a*, the second divided magnetic core 2*b*, and the third divided magnetic core 2*c*), to thereby make it possible to prevent the closed magnetic circuit core 2 from being broken and the permeability from being deteriorated.

Further, adhesives may be inserted only between the first annular bottom portion 4*a* of the first case 4 and the closed magnetic circuit core 2 and between the second annular bottom portion 5*a* of the second case 5 and the closed magnetic circuit core 2.

Also, adhesives may be inserted only between the first divided magnetic core 2*a* and the second divided magnetic core 2*b*, and between the second divided magnetic core 2*b* and the third divided magnetic core 2*c*.

Subsequently, a fourth embodiment of the present invention will be described with reference to FIG. 3.

Figure 3:
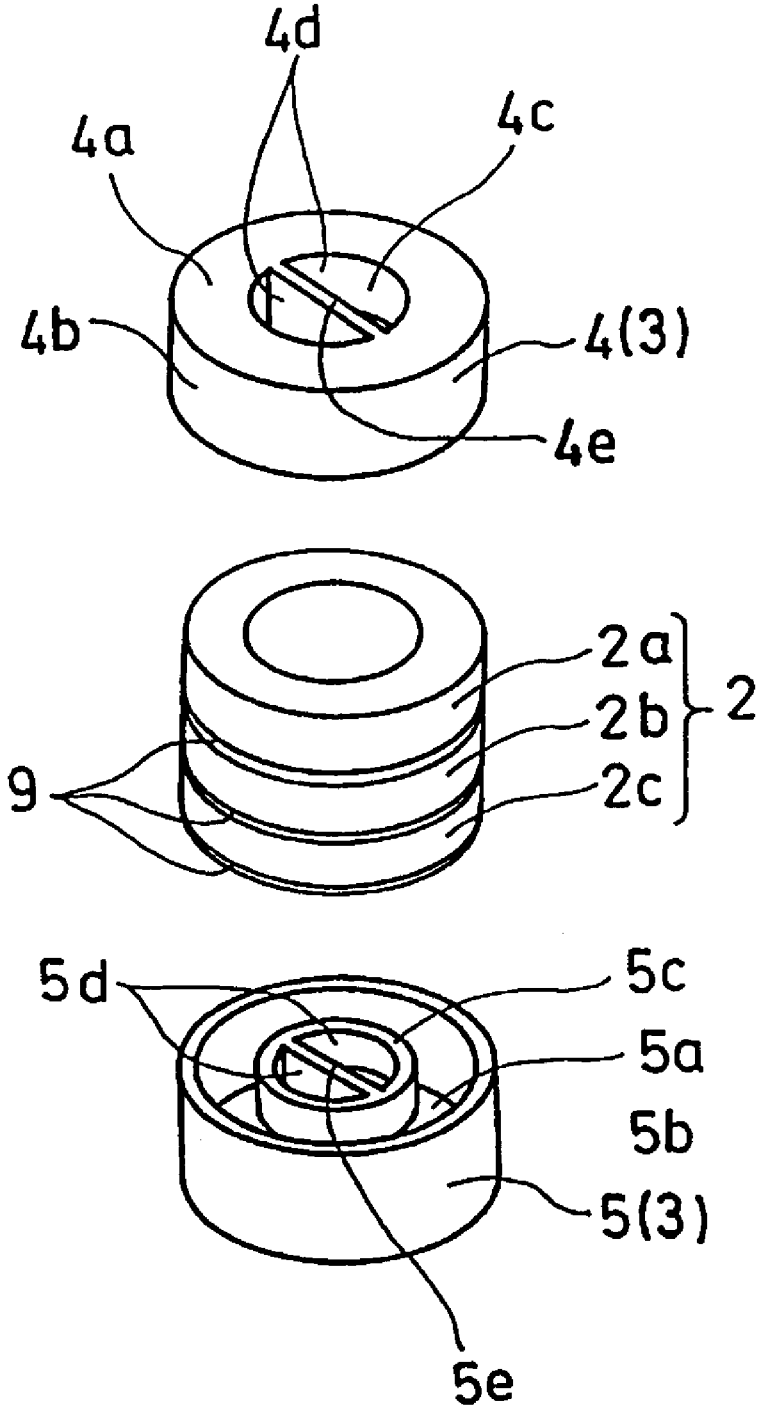
FIG. 3 is an exploded perspective view (assembly view) showing a common mode choke coil in accordance with a fourth embodiment of the present invention.

In FIG. 3, the total dimension (the dimension of height) of the first inner cylinder 4*c* and the second inner cylinder 5*c* (magnetic core inserted portion) of the insulating case 3 is made slightly larger than the dimension of height of the closed magnetic circuit core 2 structured by superimposing together the divided magnetic cores (the first divided magnetic core 2*a*, the second divided magnetic core 2*b* and the third divided magnetic core 2*c*) to form a gap (not shown) between the first annular bottom portion 4*a* of the first case 4 and the closed magnetic circuit core 2. Also, adhesives 9 are coated between the second annular bottom portion 5*a* of the second case 5 and the closed magnetic circuit core 2, between the first divided magnetic core 2*a* and the second divided magnetic core 2*b*, and between the second divided magnetic core 2*b* and the third divided magnetic core 2*c* in such a manner that the second annular bottom portion 5*a* of the second case 5 and the closed magnetic circuit core 2, the first divided magnetic core 2*a* and the second divided magnetic core 2*b*, and the second divided magnetic core 2*b* and the third divided magnetic core 2*c* are firmly fixed to each other so as to be integrated together, respectively. Also, the first coil 6 and the second coil 7 are wound on the insulating case 3 into which the closed magnetic circuit core 2 is inserted, as described above.

In the fourth embodiment, the gap is formed between the first case 4 and the closed magnetic circuit core 2 and acts as an air cushion. Therefore, even if a large force is exerted on the closed magnetic circuit core 2 side due to the first coil 6 (thick insulated wiring) and the second coil 7 (thick insulated wiring) which are wound on the thin insulated case 3, a large mechanical impact and stress can be prevented from being applied to the first divided magnetic core 2*a*, the second divided magnetic core 2*b*, and the third divided magnetic core 2*c*, to thereby make it possible to prevent the closed magnetic circuit core 2 from being broken and the permeability from being deteriorated.

In this embodiment, the gap is formed between the first annular bottom portion 4*a* of the first case 4 and the closed magnetic circuit core 2. Instead, a gap may be formed between the second annular bottom portion 5*a* of the second case 5 and the closed magnetic circuit core 2, between the first divided magnetic core 2*a* and the second divided magnetic core 2*b*, or between the second divided magnetic core 2*b* and the third divided magnetic core 2*c*.

In the embodiment shown in FIG. 3, adhesives 9 are employed. A resin 8 may be employed instead of adhesives 9. If a difference occurs between the inner diameter of the insulating case 3 and the outer diameter of the closed magnetic circuit core 2, when the gap is provided as described above, the inserted closed magnetic circuit core 2 is chatteringly moved within the insulating case 3. Therefore, in order to prevent such a movement of the closed magnetic circuit core 2, it is desirable to use the adhesive 9. In other words, the coated resin 8 which serves as the shock absorber is filled up in the roughness of the surface of the magnetic core to prevent a locally large shock or stress from being applied to the magnetic core and also acts as the shock absorber that absorbs the shock or stress whereas adhesives 9 additionally have a function of fixing the magnetic core.

In the above-described respective embodiments, the first divided magnetic core 2*a*, the second divided magnetic core 2*b*, and the third divided magnetic core 2*c* have the same cylindrical configuration. However, the present invention is not limited to this configuration, and other configurations may be applied to the first, second and third divided magnetic cores 2*a*, 2*b* and 2*c*. Also, the number of divided magnetic cores which constitute the closed magnetic circuit core 2 is not limited to three but may be other number such as 2, 4, 5 or more.

The configuration of the divided magnetic cores (the first divided magnetic core 2*a*, the second divided magnetic core 2*b*, and the third divided magnetic core 2*c*) is not limited to a cylindrical (toroidal) shape, but for example, a configuration combining two E-shaped magnetic cores, a configuration combining an E-shape magnetic core and an I-shape magnetic core, a configuration combining two U-shaped magnetic cores, a squared shaped magnetic core or a magnetic core in combination of two squares may be applied as other shapes.

EXAMPLES

Subsequently, the common mode choke coil 1 according to an embodiment of the present invention will be described with reference to FIG. 1, taken in conjunction with FIG. 4.

The common mode choke coil 1 of this embodiment is structured in the same manner as that in the above first embodiment (FIG. 1), and its dimensions and so on are set as shown in the following Table 1. Also, two prior art examples (first conventional example and second conventional example) as compared with this embodiment are also shown in FIG. 1.

The first conventional example is the prior art in which the closed magnetic circuit core 2 is of the integral core (not divided type). Also, the second conventional example is the prior art in which the closed magnetic circuit core 2 is of the integral core (not divided type), and the material of the core has the high permeability in the low frequency band. In the second conventional example, the core whose material has the high permeability in the low frequency band is used, and the number of turns is 16. Instead, the number of turns may be increased more than 16 turns (the permeability of the material in the low frequency band may not be particularly large) so that the permeability in the low frequency band becomes large.

TABLE 1

| | First conventional example | Second conventional example | This embodiment |
|---|---|---|---|
| Characteristic curve | A | B | C |
| Magnetic core configuration | Toroidal core outer diameter 38ϕ, inner diameter 22ϕ, thickness 14 mm First conventional example and second conventional example are of the integral core, and this embodiment is of the divided magnetic cores (three divided magnetic cores each 4.7 mm thick are superimposed together) | | |
| Permeability | 5000 | 7000 | 7000 |
| The number of turns | | 16 turns | |
| Impedance in each frequency | (kΩ) | (kΩ) | (kΩ) |
| 10 kHz | 0.09 | 0.17 | 0.23 |
| 6 MHz | 4.19 | 2.90 | 4.38 |
| 10 MHz | 2.91 | 2.26 | 3.22 |

Figure 4:
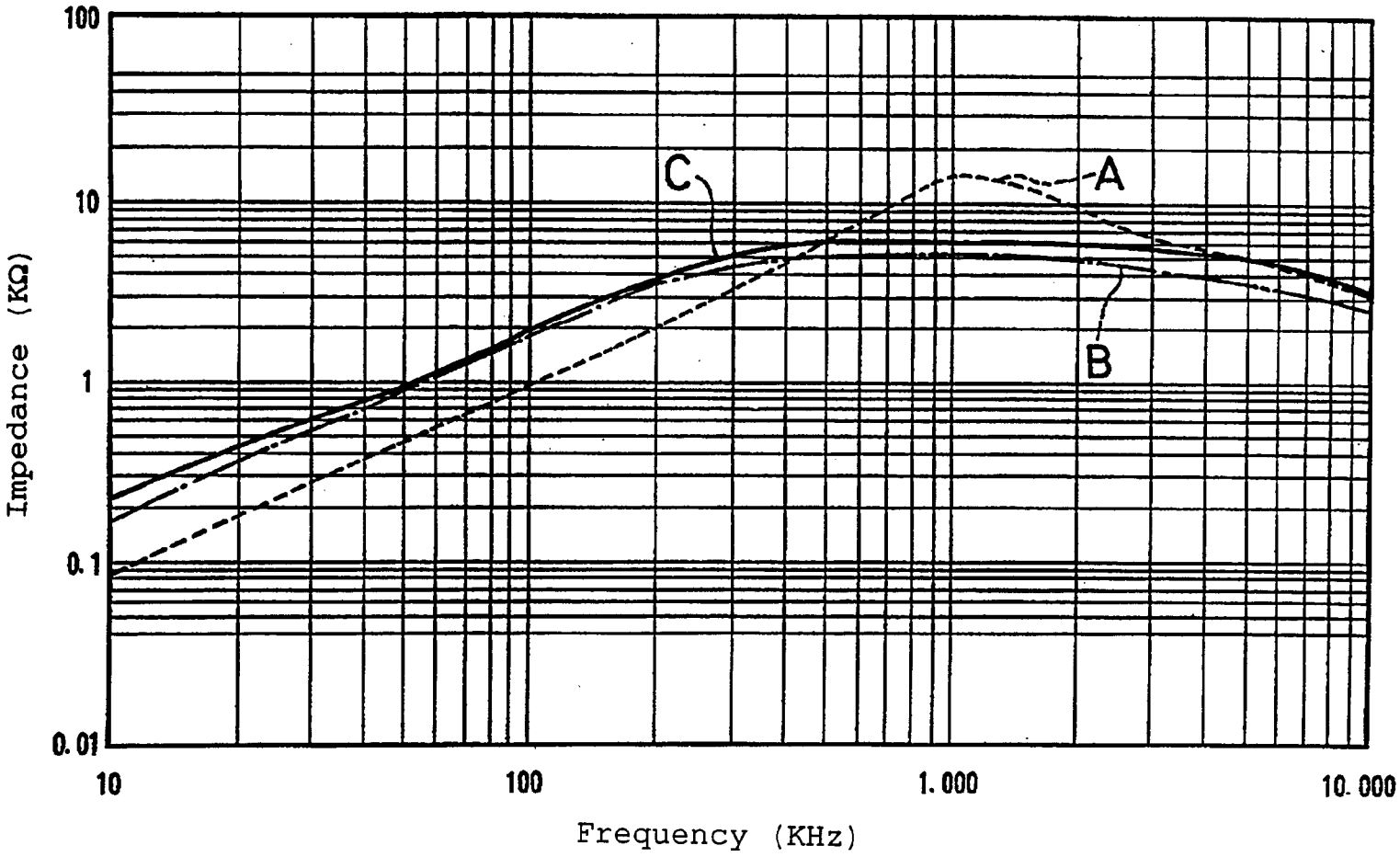
FIG. 4 is a graph showing the impedance characteristic of the common mode choke coil in accordance with an embodiment of the present invention as compared with that in the conventional example.

The impedance-frequency characteristic of the common mode choke coil 1 according to this embodiment is shown in FIG. 4.

In FIG. 4, a characteristic curve A shows the characteristic of the common mode choke coil in the first conventional example. The first conventional example can cover the impedance in the high frequency band (10 MHz side) (i.e. the impedance is large) out of the frequency band of 10 kHz to 10 MHz (10000 kHz) but does not obtain the sufficient impedance in the low frequency band (10 kHz side) (i.e. the impedance is small).

A characteristic curve B shows the characteristic of the common mode choke coil in the second conventional example. In the second conventional example, the permeability in the low frequency band becomes large whereas the impedance in the high frequency band becomes small.

A characteristic curve C shows the characteristic of the common mode choke coil 1 according to this embodiment.

As shown in FIG. 4, the characteristic curve C exhibits a smaller value of the impedance between 0.6 MHz (600 kHz) and 6 MHz (6000 kHz) as compared with the characteristic curve A, but the impedance exhibited by the characteristics curve C is the sufficient value to clear the noise regulation value in practical use. That is, the characteristic curve C may not take a value (peak value) that greatly exceeds the noise regulation clear value as in the characteristic curve A.

Accordingly, the impedance characteristic of the common mode choke coil 1 according to this embodiment exhibits a numeral value which is satisfactory over a range from the low frequency band (close to 10 kHz) to the high frequency band (close to 10 MHz), that is, 10 kHz to 10 MHz. For that reason, according to the common mode choke coil 1 of this embodiment, since the noise in the wide frequency band is sufficiently attenuated without an increase in the number of turns of the coil and the connection of two coils in series, the common mode choke coil can be downsized and the number of turns can be reduced as much.

Also, in this embodiment, the first divided magnetic core 2*a*, the second divided magnetic core 2*b* and the third divided magnetic core 2*c* have the same configuration, and the productivity can be improved as much. Further, since the closed magnetic circuit core 2 is structured by superimposed together the first divided magnetic core 2*a*, the second divided magnetic core 2*b* and the third divided magnetic core 2*c*, the thickness of the first divided magnetic core 2*a*, the second divided magnetic core 2*b* and the third divided magnetic core 2*c* is thinned. As a result, when the first divided magnetic core 2*a*, the second divided magnetic core 2*b* and the third divided magnetic core 2*c* are sintered, rapid heating and rapid cooling can be conducted, to thereby reduce the consumption of energy and remarkably reduce the costs and reduce the environmental load.

As was described above, according to the first aspect of the invention, the closed magnetic circuit core is made of oxide magnetic substance having the high permeability, and the sectional area of the divided magnetic cores which constitute the closed magnetic circuit core can be reduced. Since the closed magnetic circuit core is made of oxide magnetic substance having the high permeability, the impedance in the low frequency band (for example, the frequency band close to 10 kHz out of the frequency band of 10 kHz to 10 MHz) becomes large. Also, since the sectional area of the divided magnetic cores is set to a smaller value, the resonant frequency becomes higher due to the dimensional resonance phenomenon, and the permeability in the high frequency band (for example, the frequency band close to 10 MHz out of the frequency band of 10 kHz to 10 MHz) becomes larger, and then the impedance becomes larger. For that reason, the impedance becomes larger over the wide frequency band, and the noise in the wide frequency band of 10 kHz to 10 MHz can sufficiently be attenuated. In this situation, since the noise in the wide frequency band is sufficiently attenuated without an increase in the number of turns of the coil or without the connection of two coils in series, the common mode choke coil can be downsized and the number of turns can be reduced as much.

According to the second aspect of the present invention, since the closed magnetic circuit core is structured by superimposing together a plurality of divided magnetic cores, the thickness of the divided magnetic cores is thinned as much. As a result, when the divided magnetic cores are sintered, rapid heating and rapid cooling can be conducted, to thereby reduce the consumption of energy and remarkably reduce the costs and reduce the environmental load.

According to the third aspect of the present invention, since a plurality of divided magnetic cores have the same configuration, the plurality of divided magnetic cores and then the closed magnetic circuit core maybe readily manufactured, thereby making it possible to improve the productivity.

According to the fourth aspect of the present invention, even if a large force is exerted on the closed magnetic circuit core side when the coil is wound on the insulating case, etc., the shock absorber is inserted in at least one of a space between the insulating case and the closed magnetic core and a space between the divided magnetic cores which are superimposed together. As a result, a large mechanical impact and stress can be prevented from being applied to the divided magnetic cores, to thereby make it possible to prevent the closed magnetic circuit core from being broken and the permeability from being deteriorated.

According to the fifth aspect of the present invention, since the adhesives are coated on at least one of the portions between the insulating case and the closed magnetic circuit core and between the divided magnetic cores which are superimposed together, the insulating case and the closed magnetic circuit core, or the plurality of divided magnetic cores can be firmly integrated with each other. As a result, even if a large force is exerted on the closed magnetic circuit core side when the coil is wound on the insulating case, etc., a large mechanical impact and stress can be suppressed from being applied to the divided magnetic cores, to thereby make it possible to prevent the closed magnetic circuit core from being broken and the permeability from being deteriorated.

According to the sixth aspect of the present invention, since the gap acts as an air cushion, even if a large force is exerted on the closed magnetic circuit core side when the coil is wound on the insulating case, etc., a large mechanical impact and stress can be suppressed from being applied to the divided magnetic cores, to thereby make it possible to prevent the closed magnetic circuit core from being broken and the permeability from being deteriorated.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A common mode choke coil having two coils which are wound on a closed magnetic circuit core such that magnetic fluxes of the two coils cancel each other, wherein said closed magnetic circuit core is configured such that said closed magnetic circuit core is divided in parallel with the magnetic circuit thereof, and a plurality of divided magnetic cores which are formed of oxide magnetic substance made of the same material and are identical in configuration and winding turn with each other are superimposed together for integration, and wherein said common mode choke coil comprises an insulating case into which said closed magnetic circuit core is inserted, and said coils are wound on said closed magnetic circuit core through said insulating case.

2. The common mode choke coil as defined in claim 1, wherein adhesives are coated on at least one of portions between said insulating case and said closed magnetic circuit core and portions between said divided magnetic cores which are superimposed together.

3. The common mode choke coil as defined in claim 2, wherein a gap is formed in at least one of portions between said insulating case and said closed magnetic circuit core and portions between said adjacent divided magnetic cores.

* * * * *